US007585052B2

(12) United States Patent
Kriz et al.

(10) Patent No.: US 7,585,052 B2
(45) Date of Patent: Sep. 8, 2009

(54) TOPOGRAPHY LAYER

(75) Inventors: Adrian Kriz, Corvallis, OR (US); Bradley Chung, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 504 days.

(21) Appl. No.: 11/495,079

(22) Filed: Jul. 28, 2006

(65) Prior Publication Data

US 2008/0024558 A1 Jan. 31, 2008

(51) Int. Cl.
*B41J 2/05* (2006.01)

(52) U.S. Cl. ..... 347/56; 347/63; 347/67; 347/93

(58) Field of Classification Search ..... 347/20, 347/56, 61–65, 67, 92–94
See application file for complete search history.

(56) References Cited

U.S. PATENT DOCUMENTS 6,667,143 B2 12/2003 Nirmal et al.
6,676,241 B2 * 1/2004 Yabe ..... 347/20
6,890,063 B2 * 5/2005 Kim ..... 347/56

FOREIGN PATENT DOCUMENTS

EP 1570980 7/2005

* cited by examiner

*Primary Examiner*—Juanita D Stephens

(57) ABSTRACT

An inkjet print-head is formed by selectively disposing a first layer on a substrate. The first layer and the substrate form a topography. A second layer is selectively disposed over the substrate and the first layer. A third layer is disposed over the second layer. The second layer selectively disposed over the substrate and the first layer reduces a surface topography of the third layer.

20 Claims, 6 Drawing Sheets

TOPOGRAPHY LAYER

BACKGROUND

A primer layer disposed between two layers may promote adhesion between the two layers. A primer layer disposed between two layers may also be used to reduce stress between the two layers.

BRIEF DESCRIPTION OF THE DRAWINGS

The embodiments of a primer layer can be better understood with reference to the following drawings showing an embodiment of an inkjet printing system. The elements of the drawings may not be to scale relative to each other. Rather, emphasis has instead been placed upon clearly illustrating the embodiments of the primer layer in the embodiment of an inkjet printing system. Certain dimensions have been exaggerated in relation to other dimensions in order to provide a clearer illustration and understanding of the present disclosure. Furthermore, like reference numerals designate corresponding similar parts through the several views.

FIG. 5*b* is provided in contrast to FIG. 5*a* as an exemplary embodiment of an inkjet printing system showing a non-reduced surface topography.

DESCRIPTION

Primer layers can be useful in promoting adhesion between two layers. An example without a primer layer may occur where, a first layer may be a substrate and the second layer may be a protective overcoat. If the overcoat is applied to the substrate, the overcoat may peel, delaminate, blister, etc.

Separation of the overcoat from the substrate may be due to physical, chemical, or other types of incompatibilities between two materials. Also, the separation may be due to thermal cycling whereby the substrate and the overcoat expand at different rates. Thermal cycling may occur during manufacture of a product, use of the product, and the like. Separation may also be due to other factors.

A primer layer may be used as an intermediate layer between a substrate and a protective overcoat. The primer can have adhesion properties which are compatible with both the substrate and the protective overcoat thereby increasing the overall bond strength between the substrate and the protective overcoat. Increased bond strength may result in less peeling, blistering, delamination, etc. of the protective overcoat from the substrate. The intermediate primer layer can also serve to limit the interfacial stress between the substrate and the protective overcoat. Distributing the stress through the primer layer may also reduce the peeling, blistering, delamination, and the like.

In some embodiments, conductive and/or dielectric films may be deposited on the surface of a substrate, for example, in an integrated circuit. The films on the substrate may form topography. Adding a primer layer to a surface may promote adhesion and absorb stress, although primer layers over a surface may not substantially reduce surface topography. In some situations, it may be desirable to create a coating which does not substantially translate the topography of a film on a substrate to the topography of a surface layer, which may result in a substantially planar top surface. For instance, in an inkjet print-head, a relatively flat planar surface topography allows ejected ink from spatially arranged nozzles to strike paper with less misdirection. An inkjet print-head may be formed from an integrated circuit which may have topographical variations. Reducing topographical variations in a subsequent layer, such as an orifice layer over the integrated circuit can control the directionality of the ejected ink thereby increasing print quality and reducing the likelihood that the ink will mix.

For at least these reasons, it is desirable to retain the stress absorbing and adhesion promoting properties of a primer layer while also using the primer layer to aid in surface planarization thereby reducing topographical surface variations.

Exemplary embodiments which aid planarization using a primer layer while retaining the adhesion and stress reducing properties of the primer layer are described in reference to the following figures.

Figure 1:
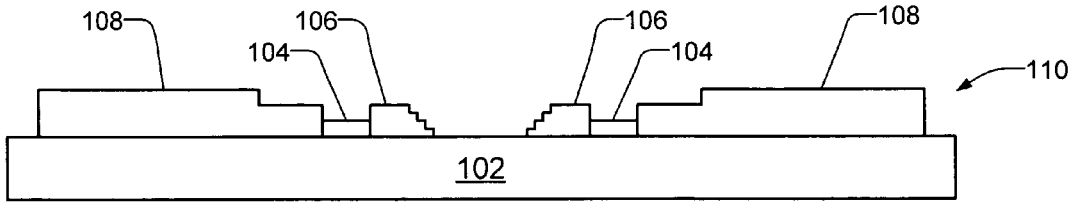
FIG. 1 shows a cross sectional diagram of layers deposited on a substrate according to an exemplary embodiment of an inkjet printing system.

FIG. 1 shows a cross sectional diagram of layers deposited on a substrate 102 according to an exemplary embodiment of an inkjet printing system. The layers may be thin film layers such as, but not limited to, thin film layers deposited by vacuum deposition. A substrate 102 forms the basis for an inkjet print-head. The substrate 102 may be silicon, silicon carbide, aluminum oxide, gallium arsenide, germanium, glass or another type of material useful in the formation of an inkjet print-head. The silicon substrate may selectively doped. The silicon substrate may be n-doped with phosphorus, p-doped with boron or doped with other materials. The doping may be by diffusion, ion implantation, or by other methods. Glass or other substrates may have amorphous semiconductors, conductors, dielectric layers, solution based compositions, or combinations thereof thereon.

Semiconducting, dielectric and conducting layers may form control logic 108 on the substrate 102. The control logic 108 serves to command a drop of ink from an inkjet print-head. The control logic 108 may contain: transistors formed from doped semiconductors; interconnects formed from conductors such as aluminum and gold; and insulating layers formed from dielectric materials such as oxides of silicon, silicon carbide, silicon nitride and the like.

An ejector 104 may be used to eject ink from an inkjet print-head. The ejector 104 may be formed from a heater resistor in the case of a thermal inkjet print-head, a piezoelectric drive element in a piezoelectric inkjet print-head, an electromechanical drive element, or other types of drive elements. A transistor (not shown) in the control logic 108 may turn on and off the ejector 104. A thermal inkjet heater resistor may be formed from tantalum, aluminum, tungsten, alloys of tantalum, aluminum, tungsten, or other types of materials or alloys.

Connector 106 serves to conduct current and voltage from the thin film control logic 108 to the ejector 104. Connector 106 may have electrical conductors such as aluminum and may have electrical dielectrics such as silicon nitride, silicon carbide, and other oxides of silicon. The dielectrics may serve as electrical insulators between electrical conductors and also to passivate the electrical conductors, thereby protecting the electrical conductors from corrosion of ink. Tantalum can be applied to the electrical conductors and may aid adhesion. Tantalum may also be used for cavitation protection on the ejector 104. The ejector 104, connector 106, and control logic 108 may all together be considered a first layer 110 having a topography on a substrate 102.

Figure 2:
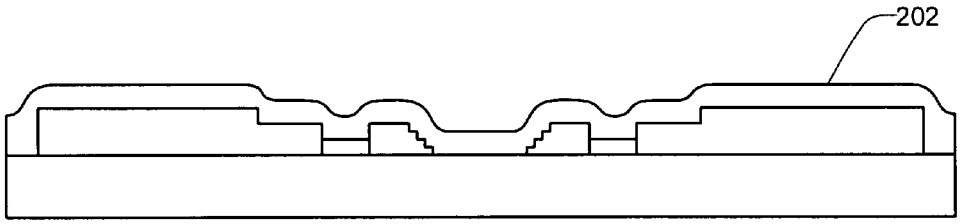
FIG. 2 illustrates a cross sectional diagram of a primer layer over the layers and the substrate according to an exemplary embodiment of an inkjet printing system.

FIG. 2 illustrates a cross sectional diagram of a primer layer 202 coating over a substrate 102, control logic 108, connector 106 and ejector 104 according to an exemplary embodiment of an inkjet printing system. The primer layer 202 coating may be an epoxy based photoresist and may be coated as a liquid, a solid, or in vapor form. A liquid primer layer 202 may be spun on, sprayed on, or applied by other methods to form a coating. A solid film primer layer 202 may be rolled on to form a coating. The primer may be volatilized into a vapor and condensed to form a coating. Other methods of applying a primer layer 202 may also be used to form a coating. The primer layer 202 may be about 4 microns thick, although other thicknesses may be used. The foregoing examples are intended to describe the application of the primer layer 202, substances used for the primer layer 202, and processes used to apply the primer layer 202. Thus, these examples are therefore not limited. The primer layer 202 may be used to increase adhesion and reduce stress between the under layer and a subsequently applied over layer. The primer layer 202 may be considered a second layer.

Figure 3:
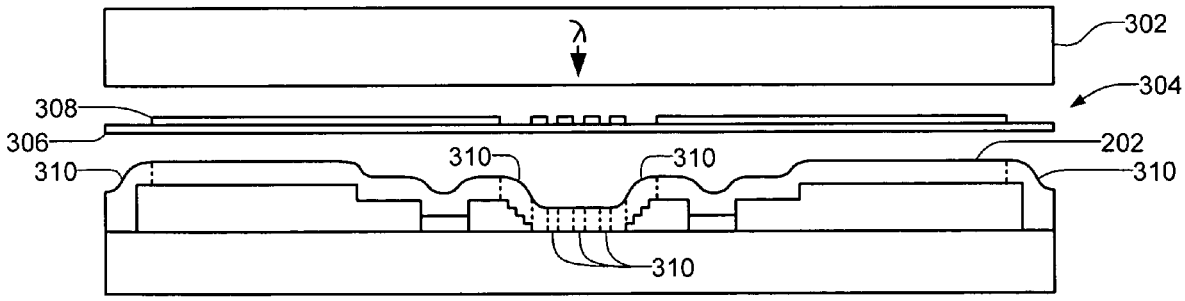
FIG. 3 shows a cross sectional diagram of an exposed primer layer according to an exemplary embodiment of an inkjet printing system.

FIG. 3 shows a cross sectional diagram of an exposed primer layer 202 according to an exemplary embodiment of an inkjet printing system. The primer layer 202 is selectively exposed to radiation 302 and may form features in the primer layer 202. The selective exposure of the primer layer 202 to radiation 302 may be accomplished by use of a primer mask 304. A primer mask 304 may be made of a transparent substrate 306 such as, but not limited to, glass, and a blocking layer 308, such as, but not limited to, chrome. The primer mask 304 allows radiation 302 to pass through areas that are not blocked by a blocking layer 308 thereby radiating into exposed primer areas 310 of primer layer 202. The primer layer 202 under the blocking layer 308 is not exposed to radiation 302. The radiation 302 may be ultraviolet radiation. Upon exposure to radiation 302, the exposed primer areas 310 of the primer layer 202 are crosslinked by the radiation 302 and become at least partially cured. The primer thus may serve as a negative acting photoresist.

Three exposed primer areas 310 are shown between the connectors 106 for illustrative purposes. There may be more or less than three exposed primer areas 310 between the connectors 106. The exposed primer areas 310 between the connectors 106 may form the base of pillars. The pillars may be circular shaped, square shaped, rectangular shaped or have another shape. The pillars may serve to filter particles from ink in an inkjet print-head. The pillars may also serve to filter particles from a liquid in an inkjet print-head. The liquid may be ink, but is not limited to ink. The liquid may be a chemical binder, a chemical fixer, an assay, and the like.

However, the exposed primer areas 310 may be located in other areas. Thus the exposed primer areas 310 are not restricted to being placed between the connectors 106. For example, the exposed primer areas 310 may be located on a portion of a substrate 102 which does not have control logic 108 or other features such as a layer of tantalum and gold which may be used on a print-head for passivation purposes. In one embodiment of a print-head, the height of tantalum and gold is about 1.7 microns. Thus, exposed primer areas 310 may be formed on a portion of the substrate 102 where tantalum and gold is absent in order to aid in planarizing the thickness of subsequent layers. In other words, the exposed primer areas 310 may be used to compensate for the thickness of the tantalum and gold layers in areas where tantalum and gold is not present.

In one embodiment of a print-head, the exposed primer areas 310 to compensate for the about 1.7 micron height of tantalum and gold are circular shaped with a diameter of about 39 microns and a thickness of about 4 microns. The circular shaped structure having a thickness forms a cylinder. One or more of these cylinders may be placed adjacent to each other in areas where tantalum and gold is absent. 40 percent of the area may be uniformly filled with the cylinders. This 40 percent area fill may be used to compensate for the thickness of a tantalum and gold layer in areas where tantalum and gold is not present.

Figure 4:
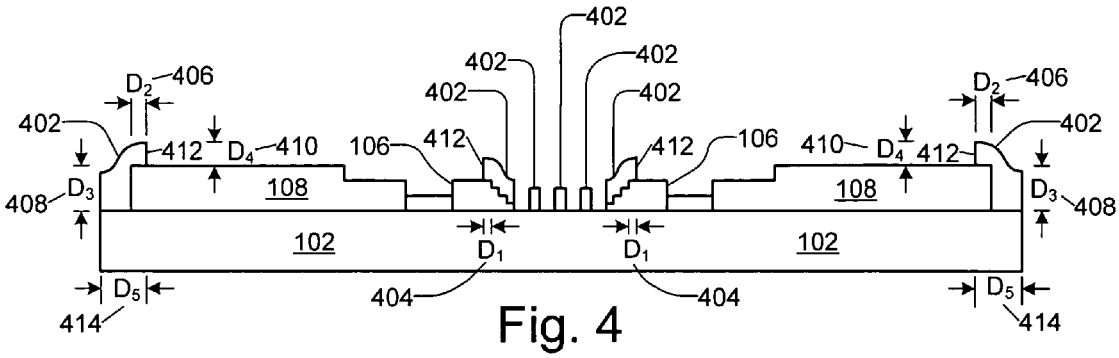
FIG. 4 shows a cross sectional diagram of a developed primer layer according to an exemplary embodiment of an inkjet printing system.

FIG. 4 shows a cross sectional diagram of a developed primer layer according to an exemplary embodiment of an inkjet printing system. The primer layer 202 which has not been exposed to radiation due to the blocking layer 308 on the mask 304 is not crosslinked, and can be rinsed away by a developer solution such as ethyl lactate. The at least selectively exposed primer areas 310 are at least partially cured, and therefore are not developed away by the developer solution. Hence, the selectively exposed primer areas 310 remain and become patterned primer features 402 in the primer layer 202. The patterned primer features 402 between the connectors 106 may form the base of pillars. The pillars may be circular shaped, square shaped, rectangular shaped or have another shape. The pillars may serve to filter particles from ink in an inkjet print-head.

However, the patterned primer features 402 may be located in other areas. Thus the patterned primer features 402 are not restricted to being placed between the connectors 106. For example, the patterned primer features 402 may be located on a portion of a substrate 102 which does not have control logic 108 or other features such as a layer of tantalum and gold which may be used on a print-head for passivation purposes. In one embodiment of a print-head, the height of tantalum and gold is about 1.7 microns. Thus, patterned primer features 402 may be formed on a portion of the substrate 102 where tantalum and gold is absent in order to aid in planarizing the thickness of subsequent layers. In other words, the patterned primer features 402 may be used to compensate for the thickness of the tantalum and gold layers in areas where tantalum and gold is not present.

In one embodiment of a print-head, the patterned primer features 402 compensate for the about 1.7 micron height of the tantalum and gold and are circular shaped with a diameter of about 39 microns and a thickness of about 4 microns. The circular shaped structure forms a cylinder. One or more of these cylinders may be placed side by side where about 40 percent of the area lacking tantalum and gold is uniformly filled with the cylinders. This 40 percent area fill may be used to compensate for the thickness of a tantalum and gold layer in areas where tantalum and gold is not present.

The patterned primer features 402 partially cover the control logic 108 and the connector 106 layers. The patterned primer features 402 may overlap the connector layers 106 and the control logic 108 a lateral distance ($D_1$) 404 and ($D_2$) 406 respectively. These lateral distances ($D_1$) 404 and ($D_2$) 406 may be different. If the lateral distance ($D_2$) 406 is greater than about 10 times the thickness of a height difference ($D_3$) 408 then the stress within the patterned primer feature 402 and the stress of subsequent layers at the topographical boundary interface may be reduced. As an example, a topographical boundary occurs between the substrate 102 and the control logic 108 layer as indicated by the height difference ($D_3$) 408 of the topographical boundary.

This partial coverage of the patterned primer feature 402 having a lateral distance ($D_2$) 406 can increase the interfacial adhesion and reduce stress within the patterned primer features 402. The partial coverage having a lateral distance ($D_2$) 406 may also reduce the stress between the control logic 108 layer and a subsequent layer applied over the control logic 108 layer. Similarly, the partial coverage of the patterned primer features 402 may increase interfacial adhesion and reduce stress within the patterned primer features 402 and between the connector 106 layer and a subsequent layer applied over the connector 106 layer.

Another stress reduction technique is to overlap the control logic 108 with the patterned primer features 402 a lateral distance ($D_2$) 406 of at least 3 times the thickness ($D_4$) 410 of the patterned primer features 402. The lateral distance ($D_2$) extends from an exposed boundary 412. As an example, the thickness ($D_4$) 410 of the patterned primer features 402 can be 4 microns. Therefore, the overlap lateral distance ($D_2$) 406 of the patterned primer feature 402 is 3 times 4 microns, or 12 microns. The overlap lateral distance ($D_2$) 406 can also be 10 times the thickness ($D_4$) 410 of the patterned primer features 402 to provide more stress reduction. Furthermore, the overlap lateral distance ($D_2$) 406 can be 15 times the thickness ($D_4$) 410 of the patterned primer features 402. Increasing the overlap lateral distance ($D_2$) 406 from 10 to 15 times the thickness ($D_4$) 410 of the patterned primer features 402 may not proportionally increase stress reduction, but can provide margin. Similarly connector 106 may be overlapped with the patterned primer features 402. The overlap lateral distance extends from an exposed boundary 412. The overlap lateral distance ($D_1$) 404 ranges from about 3 to 15 times the thickness ($D_4$) 410 of the patterned primer features 402.

Yet another stress reduction technique is for patterned primer features 402 to have a lateral distance ($D_5$) 414 which is at least 3 times greater than the thickness ($D_4$) of the patterned primer feature 402. The lateral distance ($D_5$) may be 15 times greater than the thickness ($D_4$) to provide for margin.

These techniques of stress reduction may be applied to high stress areas within an inkjet print-head. Other areas in an inkjet print-head which are not subject to high stresses such as the patterned primer features 402 between the connectors 106 may not apply this stress reduction technique.

Figure 5A:
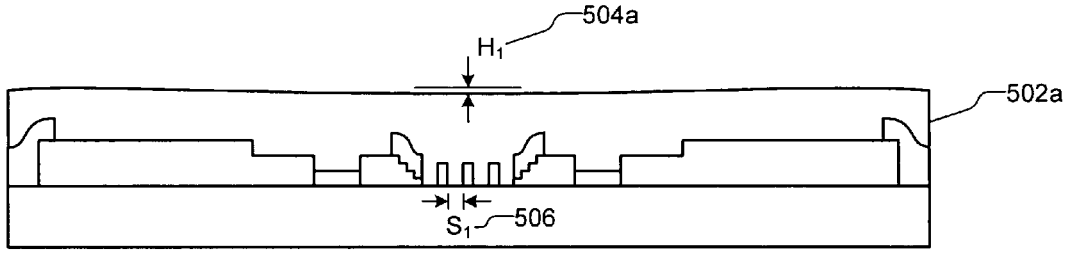
FIG. 5*a* illustrates a cross sectional diagram of a chamber layer over the developed primer layer showing a relatively small surface topography according to an exemplary embodiment of an inkjet printing system.

FIG. 5*a* illustrates a cross sectional diagram of a chamber layer 502*a* coating over the patterned primer features 402 according to an exemplary embodiment of an inkjet printing system showing reduced surface topography. The chamber layer 502*a* has a relatively small peak-to-valley height ($H_1$) 504*a* of about 0.3 microns on an inkjet print-head. This relatively small peak-to-valley height ($H_1$) 504*a* decreases the amount of chemical mechanical polishing (CMP) planarization in a subsequent process step thereby saving time and processing materials. The chamber layer 502*a* may be considered a third layer.

Figure 7:
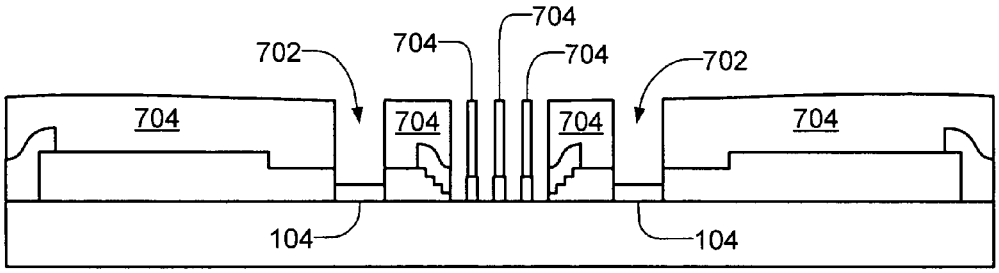
FIG. 7 illustrates a cross sectional diagram of a developed chamber layer according to an exemplary embodiment of an inkjet printing system.

A chamber layer 502*a* is deposited over the patterned primer features 402. The chamber layer 502*a* may be about 15 microns thick; however other thicknesses may be used. The chamber layer 502*a* is used to form a cavity 702 as shown in FIG. 7 which serves as an ink reservoir over the ejector 104, whereby the ejector 104 jets ink from the formed cavity 702. The chamber layer 502*a* may be an epoxy based photoresist and may be coated as a liquid, a solid, or a vapor. A liquid chamber layer 502*a* may be spun on, sprayed on, or applied by other methods. A solid film chamber layer 502*a* may be rolled on. The chamber layer 502*a* may be vaporized and condensed on. Other methods of coating a chamber layer 502*a* may also be used. The foregoing examples are intended to describe application of the chamber layer 502*a*, substances used for the chamber layer 502*a*, and methods used to apply the chamber layer 502*a*, and therefore are not limiting.

If the patterned primer features 402 are spaced apart with a first spacing ($S_1$) 506 of about 250 microns or less, then the chamber layer 502*a* coats the patterned primer features 402 relatively uniformly. The first spacing ($S_1$) 506 is the distance between the patterned primer features 402. The first spacing ($S_1$) 506 between the patterned primer features 402 may be about 4 microns. Tests have shown that if the distance between the patterned primer features 402 is about 4 microns, a subsequent layer—such as the chamber layer which is over the patterned primer features 402—can planarize the surface of the subsequent layer to less than 0.3 microns. The patterned primer features 402 may be spaced apart about 10 to 12 microns and can result in a subsequent surface planarity of about 0.3 microns.

The patterned primer features 402 translate to reduced surface topography of the chamber layer 502*a* and therefore can substantially reduce the amount of subsequent chemical mechanical polishing (CMP) processing. As an example, FIG. 5*a* shows a relatively small peak-to-valley height ($H_1$) 504*a* of 0.3 microns. The relatively small peak-to-valley height ($H_1$) 504*a* decreases the amount of CMP planarization and can save time and processing material.

Figure 13:
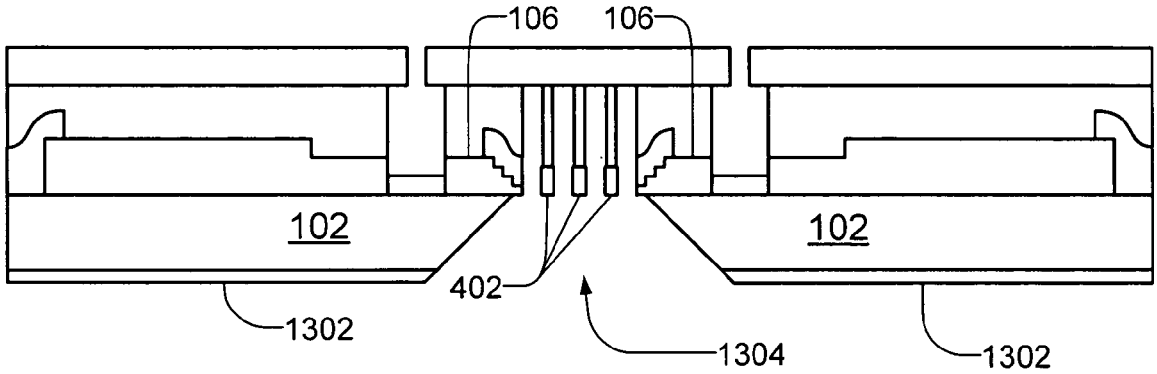
FIG. 13 illustrates a cross sectional diagram of an etched substrate according to an exemplary embodiment of an inkjet printing system.

The patterned primer features 402 between the connectors 106 when spaced apart about 10 microns to 12 microns may trap particles embedded in ink. If particles in the ink are not trapped, the particles may clog nozzles and reduce print quality. The patterned primer features 402 may thus serve to create a filter for ink particles thereby creating a particle tolerant architecture for a print-head. The use of ink is not limiting since an inkjet print-head may also use other fluids or liquids. The patterned primer features 402 serving to trap particles are shown in FIG. 13. Although three patterned primer features 402 are shown between the conductors 106, more or less than three patterned primer features 402 may be used. The patterned primer features 402 between the conductors 106 may be pillars.

Figure 5B:
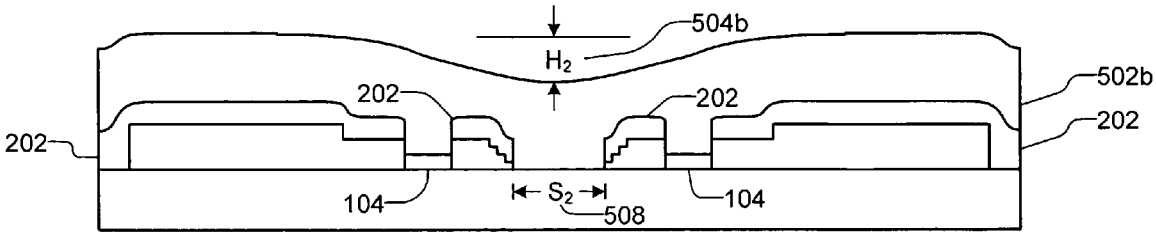
Fig. 5b Prior Art
FIG. 5*b* illustrates a cross sectional diagram of a chamber layer over an unpatterned primer layer showing a relatively large surface topography according to an exemplary embodiment of an inkjet printing system.

FIG. 5*b* illustrates a cross sectional diagram of a chamber layer 502*b* over a primer layer 202 according to a prior art exemplary embodiment of an inkjet printing system. FIG. 5*b* is provided in contrast to FIG. 5*a* as an exemplary embodiment of a prior art inkjet printing system showing a relatively large surface topography. The relatively large surface topography results from the primer layer 202 being removed from areas between the connectors 106, and not being removed in areas over the control logic 108 and the connectors 106.

The primer layer 202 is spaced apart by a second spacing ($S_2$) 508 so that ink may be fed through the etched away area 1304 of substrate 102 as shown in FIG. 13. An ink feed hole may have a second spacing ($S_2$) 508 up to 1 millimeter or more. The primer layer 202 in FIG. 2 is exposed, and developed to form the second spacing ($S_2$) 508 in FIG. 5. The primer layer 202 in FIG. 2 is also exposed and developed to remove the primer above the ejector 104 such that ink may be allowed to come in contact with the ejector.

The measured peak-to-valley height ($H_2$) 504*b* of chamber layer 502*b* on an inkjet print-head having spacing ($S_2$) 508 is about 3 microns. This relatively large peak-to-valley height ($H_2$) 504*b* of 3 microns increases the amount of subsequent chemical mechanical polishing (CMP) to planarize the inkjet print-head.

The ratio of the peak-to-valley height ($H_2$) 504*b* relative to the peak-to-valley height ($H_1$) 504*a* is; 3 microns divided by 0.3 microns or 10. Therefore, patterned primer features 402 have reduced the surface topography of chamber layer 502 about 10 times. The chamber layer 502 may be considered a third layer.

Figure 6:
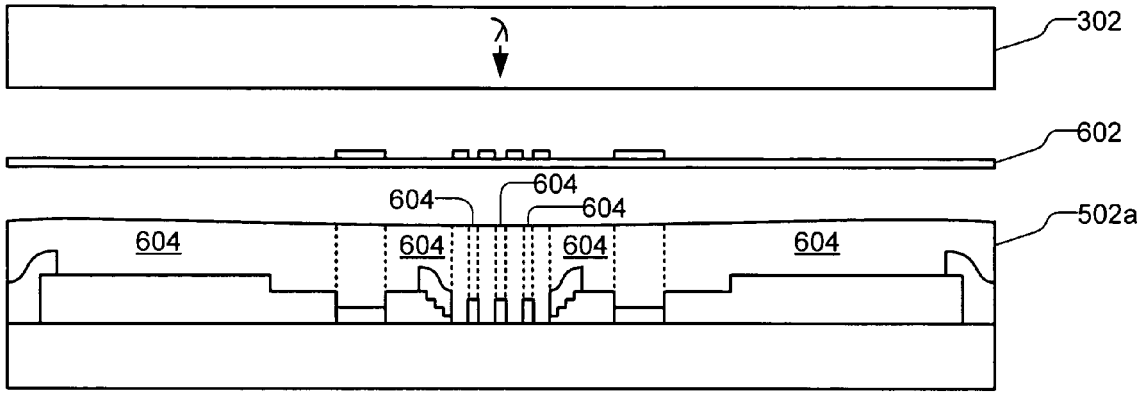
FIG. 6 shows a cross sectional diagram of an exposed chamber layer according to an exemplary embodiment of an inkjet printing system.

FIG. 6 shows a cross sectional diagram of an exposed chamber layer according to an exemplary embodiment of an inkjet printing system. The chamber layer 502*a* may be a negative acting epoxy based photoresist. Radiation 302 exposes the chamber layer 502*a* through a chamber mask 602. The radiation 302 may be ultraviolet radiation. Exposed chamber areas 604 of the chamber layer 502*a* may become crosslinked by the radiation 302 and can be at least partially cured.

FIG. 7 illustrates a cross sectional diagram of a developed chamber layer 704 according to an exemplary embodiment of an inkjet printing system. The exposed chamber areas 604 shown in FIG. 6 remain intact and thereby become the developed chamber layer 704. The rest of the chamber layer 502*a* is shown in FIG. 5*a* but not shown in FIG. 7 because the rest of the chamber layer 502*a* is selectively developed away by a developer, such as, but not limited to, ethyl lactate. The cavity 702 which is developed away serves as an ink reservoir over ejector 104.

Figure 8:
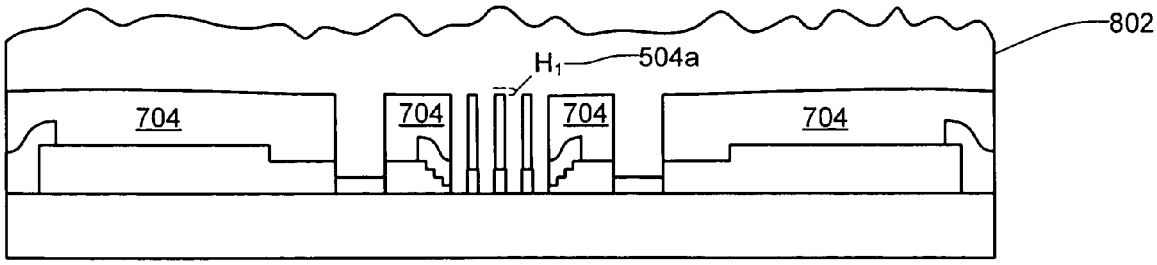
FIG. 8 shows a cross sectional diagram of a wax layer over a developed chamber layer according to an exemplary embodiment of an inkjet printing system.

FIG. 8 shows a cross sectional diagram of a wax layer 802 over the exposed and developed chamber areas 704 according to an exemplary embodiment of an inkjet printing system. The wax layer 802 may be formed from a polymer in a solvent and serves to prepare a partially finished print-head assembly 804 for a subsequent chemical mechanical polishing (CMP) process. The wax layer may be spun on or deposited using other methods. The subsequent CMP process polishes away exposed chamber areas 704 to remove the relatively small peak-to-valley height ($H_1$) 504*a*. In contrast, FIG. 5*b* shows the relatively large peak-to-valley height ($H_2$) 504*b* to be CMP processed. CMP processing the relatively large peak-to-valley height ($H_2$) 504*b* takes substantially more time and material than CMP processing the relatively small peak-to-valley height ($H_1$) 504*a*.

Figure 9:
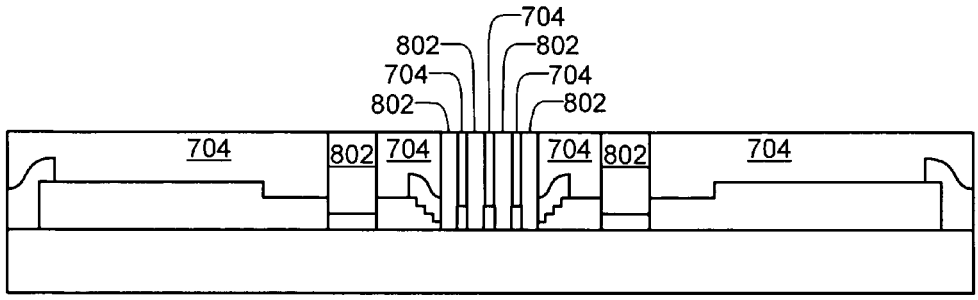
FIG. 9 illustrates a cross sectional diagram of an exemplary embodiment of a thermal inkjet printing system after chemical mechanical polishing (CMP) according to an exemplary embodiment of an inkjet printing system.

FIG. 9 illustrates a cross sectional diagram of an exemplary embodiment of a thermal inkjet print-head after CMP according to an exemplary embodiment of an inkjet printing system. The exposed chamber area 704 is chemical mechanical polished and planarized. Due to the relatively small peak-to-valley height ($H_1$) 504*a*, a relatively small amount of exposed chamber area 704 material is removed, thereby saving CMP processing time and material.

Figure 10:
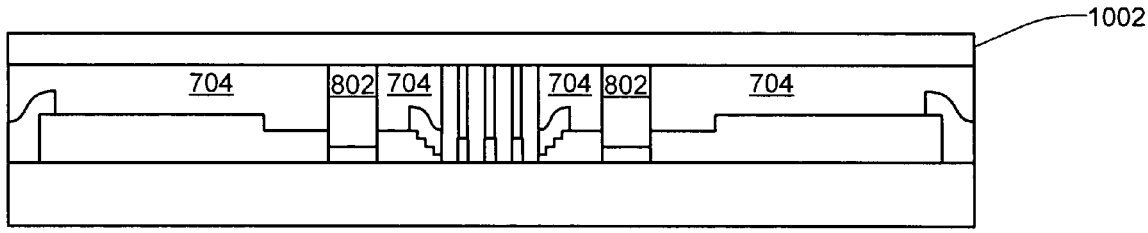
FIG. 10 shows a cross sectional diagram of a nozzle layer over a CMP wax filled chamber layer according to an exemplary embodiment of an inkjet printing system.

FIG. 10 shows a cross sectional diagram of a nozzle layer 1002 coated over a CMP wax filled layer 802 and an exposed chamber 704 layer according to an exemplary embodiment of an inkjet printing system. The nozzle layer 1002 may be applied as a film, spun on, vapor deposited, or applied by another process.

Figure 11:
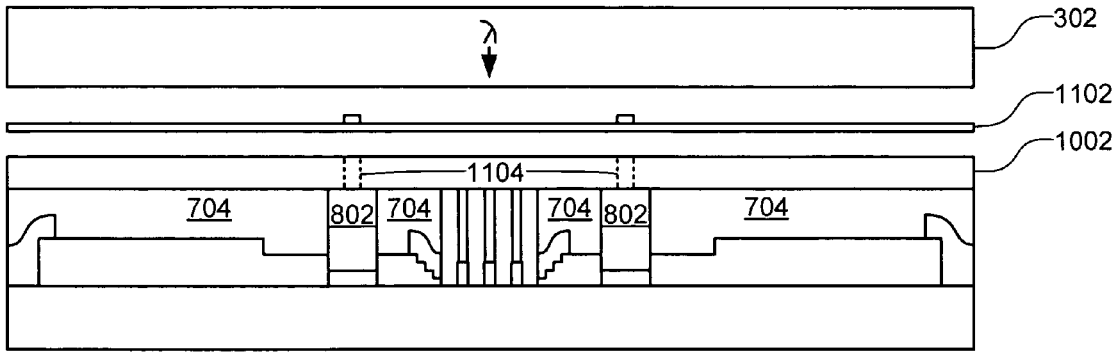
FIG. 11 illustrates a cross sectional diagram of an exposed nozzle layer according to an exemplary embodiment of an inkjet printing system.

FIG. 11 illustrates a cross sectional diagram of an exposed nozzle layer 1002 according to an exemplary embodiment of an inkjet printing system. Radiation 302 is selectively blocked by nozzle mask 1102 to form unexposed nozzle areas 1104. The radiation may be an ultraviolet radiation or other types of radiation.

Figure 12:
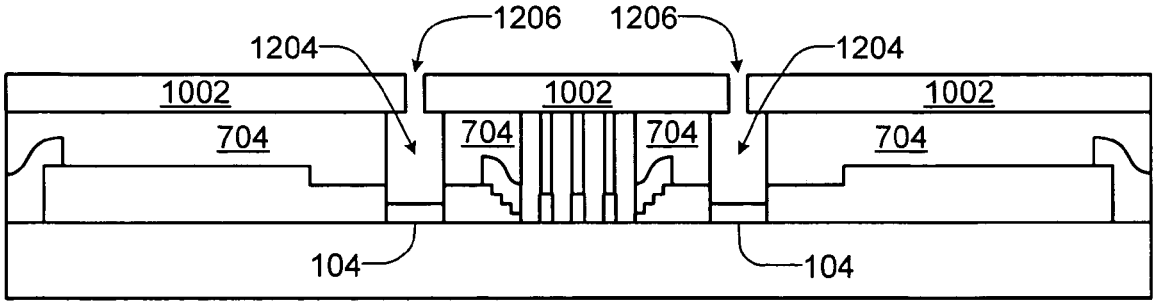
FIG. 12 shows a cross sectional diagram of a developed nozzle layer according to an exemplary embodiment of an inkjet printing system.

FIG. 12 shows a cross sectional diagram of a developed nozzle layer 1002 and a developed wax cavity 1204 according to an exemplary embodiment of an inkjet printing system. A developer such as ethyl lactate may be used to remove the unexposed nozzle areas 1104 as shown in FIG. 11 and the wax layer 802 as shown in FIGS. 8 through 11 to form the developed wax cavity 1204. The wax cavity 1204 serves as a chamber for containing ink so that ejector 104 can fire ink from the nozzle 1206. In an inkjet print-head, ink is fired from the nozzles 1206.

FIG. 13 illustrates a cross sectional diagram of an etched away area 1304 of a substrate 102 according to an exemplary embodiment of an inkjet printing system. An etch resist mask 1302 may be applied below the substrate 102 to define the etched away area 1304 of the substrate 102. A dry etch using a plasma, a wet etch using a liquid, or a laser etch may be used. Moreover, the etching may be a combination of wet, dry, or laser etching. Other methods of etching may also be used. In an inkjet printing system, ink fills the etched away area 1304 of the substrate 102. Other liquids may be used in place of ink.

Figure 14:
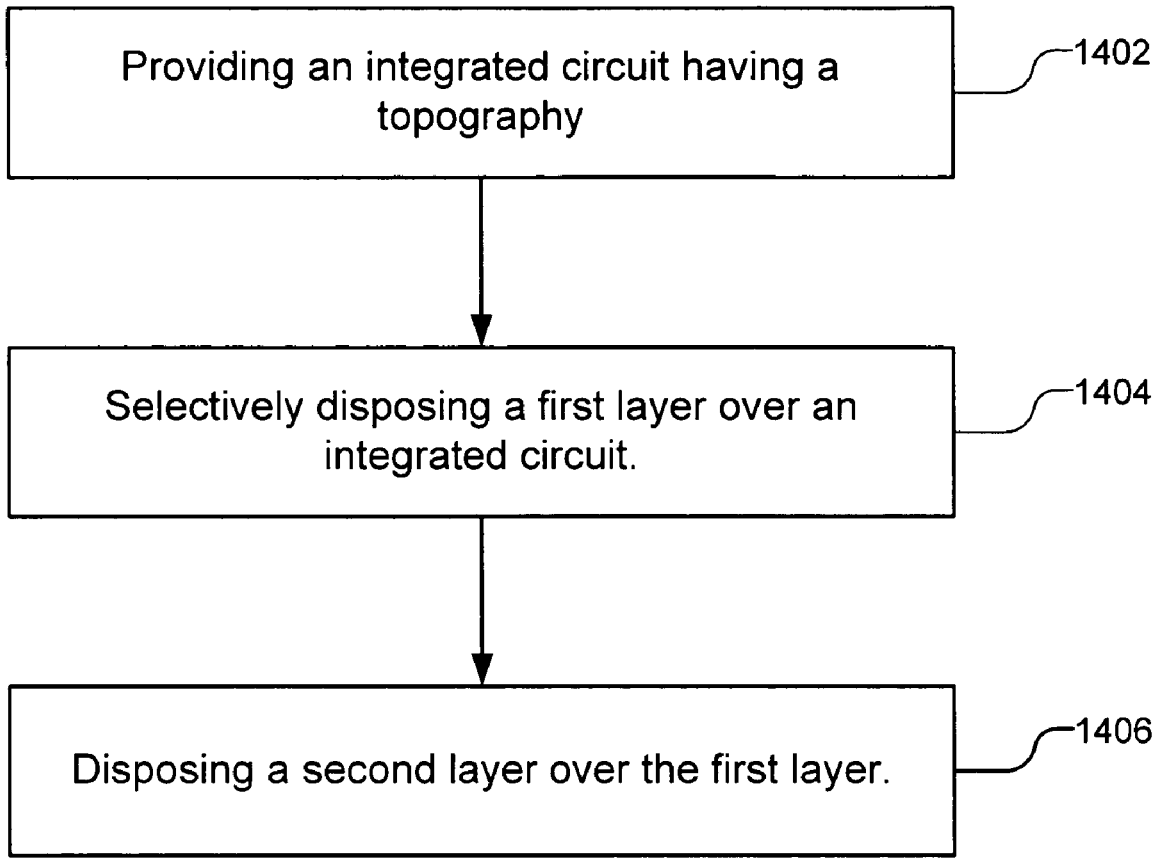
FIG. 14 shows a flow diagram having procedural acts for making an inkjet print-head according to an exemplary embodiment of an inkjet printing system.

FIG. 14 shows a flow diagram having procedural acts for making an inkjet print-head according to an exemplary embodiment of an inkjet printing system. In act 1402, an integrated circuit is provided having topography. An integrated circuit may be formed on a substrate 102. Control logic 108, connectors 106, and ejectors 102 may be formed on the substrate as described in reference to FIGS. 1 through 13. Layers formed from the control logic 108, connectors 106, and ejectors 102 may have, as an example, a topographical height difference ($D_3$) 408 causing a height variation at a topographical interface boundary as shown in FIG. 4. Layers formed from the control logic 108, connectors 106, and ejectors 102 may be considered as a first layer.

In act 1404, a second layer such as the primer layer 202 in FIG. 2 may be disposed over the integrated circuit having topography. The primer layer may be selectively disposed over the integrated circuit to form patterned primer features 402 as shown by masking, exposing, and developing in FIGS. 3 and 4.

In act 1406, a third layer such as a chamber layer 502*a* may be disposed over the second layer as shown in FIG. 5*a*. The second layer may have a reduced surface topography ($H_1$) 504*a* in FIG. 5*a* in contrast with surface topography ($H_2$) in FIG. 5*b*.

The present embodiments of an inkjet printing system show cross sections of two inkjet nozzles for illustration and exemplary purposes. It should be appreciated that a multiplicity of inkjet nozzles may be formed in accordance to the information described herein.

While the present embodiments of an inkjet printing system have been particularly shown and described, those skilled in the art will understand that many variations may be made therein without departing from the spirit and scope of the embodiments defined in the following claims. The description of the embodiment is understood to include all novel and non-obvious combinations of elements described herein, and claims may be presented in this or a later application to any novel and non-obvious combination of these elements. The foregoing embodiments are illustrative, and no single feature or element would have to be included in all possible combinations that may be claimed in this or a later application. Where the claims recite "a" or "a first" element of the equivalent thereof, such claims should be understood to include incorporation of one or more such elements, neither specifically including nor excluding two or more such elements.

What is claimed is:

1. An inkjet print-head comprising:

a first layer selectively disposed on a substrate, the first layer and the substrate forming a topography;

a second layer selectively disposed over the substrate and the first layer, the second layer comprising at least one feature disposed on and making contact with the substrate; and a third layer disposed over the second layer, wherein the second layer selectively disposed over the substrate and the first layer reduces a surface topography of the third layer.

2. The inkjet print-head in claim 1, wherein a height variation of the surface topography of the third layer is about 0.3 microns.

3. The inkjet print-head in claim 1, wherein the at least one feature of the second layer selectively disposed over the substrate and the first layer comprises a plurality of features.

4. The inkjet print-head in claim 3, wherein the plurality of features are spaced apart a distance of about 4 microns to about 250 microns apart.

5. The inkjet print-head in claim 3, wherein the plurality of features are spaced apart a distance of about 10 microns to about 12 microns apart.

6. The inkjet print-head in claim 1, wherein the at least one feature includes at least one pillar.

7. The inkjet print-head in claim 6, wherein the at least one pillar is designed to trap at least one particle.

8. The inkjet print-head in claim 1, wherein the at least one feature includes at least one cylinder.

9. The inkjet print-head in claim 1, wherein the second layer overlaps the first layer a lateral distance from an exposed boundary of the second layer; and the lateral distance is about 3 to 15 times a thickness of the second layer.

10. The inkjet print-head in claim 1, wherein the second layer further comprises an adhesion promoter whereby adhesion between the first layer and the substrate, and the third layer is increased.

11. The inkjet print-head of claim 1, wherein the first layer is variable in height above the substrate along a direction perpendicular to and upwards from the substrate, where all portions of the first layer make contact with the substrate.

12. The inkjet print-head of claim 1, wherein the second layer is an epoxy-based photoresist.

13. A method for making an inkjet print-head comprising:

providing an integrated circuit having a topography, whereby the integrated circuit has a first layer of circuitry on a substrate;

selectively disposing a second layer over the integrated circuit having the topography, such that the second layer comprises at least one feature disposed on and making contact with the substrate;

disposing a third layer over the second layer, wherein disposing the third layer over the second layer further comprises reducing a surface topography of the third layer.

14. The method for making an inkjet print-head in claim 13 wherein selectively disposing the second layer over the integrated circuit having the topography further comprises forming the at least one feature in the second layer.

15. The method for making an inkjet print-head in claim 13 wherein selectively disposing the second layer over the integrated circuit having the topography further comprises forming a plurality of features, including the at least one feature, in the second layer.

16. The method for making an inkjet print-head in claim 13, wherein the plurality of features are spaced apart a distance of about 4 microns to about 250 microns apart.

17. The method for making an inkjet print-head in claim 13, wherein the plurality of features are spaced apart a distance of about 10 microns to about 12 microns apart.

18. The method for making an inkjet print-head in claim 13, wherein the second layer overlaps the first layer at an exposed boundary of the second layer from about 3 to 15 times the thickness of the second layer.

19. The method of claim 13, wherein the first layer is variable in height above the substrate along a direction perpendicular to and upwards from the substrate, where all portions of the first layer make contact with the substrate.

20. The method of claim 13, wherein the second layer is an epoxy-based photoresist.

* * * * *